United States Patent [19]

Takigawa et al.

[11] Patent Number: 4,580,152

[45] Date of Patent: Apr. 1, 1986

[54] HEAT SENSITIVE TRANSFER METHOD

[75] Inventors: Nobuhiro Takigawa, Numazu; Keishi Kubo, Yokohama; Hideo Watanabe, Numazu; Minoru Hakiri, Numazu; Kanjirou Kawasaki, Numazu, all of Japan

[73] Assignee: Ricoh Co., Ltd., Tokyo, Japan

[21] Appl. No.: 662,203

[22] Filed: Oct. 18, 1984

[30] Foreign Application Priority Data

Oct. 20, 1983 [JP] Japan ..... 58-196796

[51] Int. Cl.[4] ..... B41M 5/28

[52] U.S. Cl. ..... 346/201; 346/207; 346/208; 346/209; 346/216; 346/226; 427/150

[58] Field of Search ..... 346/207, 216, 217, 225, 346/226, 201, 208, 209; 427/150, 151, 152

[56] References Cited

U.S. PATENT DOCUMENTS 4,333,984 6/1982 Igarashi et al. ..... 346/226

4,408,781 10/1983 Watanabe ..... 346/225

FOREIGN PATENT DOCUMENTS 0080095 5/1982 Japan ..... 346/225

0035986 2/1984 Japan ..... 346/225

*Primary Examiner*—Bruce H. Hess

*Attorney, Agent, or Firm*—Flynn, Thiel, Boutell & Tanis

[57] ABSTRACT

The present invention is directed towards a method for carrying out heat sensitive transfer which comprises using a transfer sheet having a leuco dye-containing transfer layer and a receiving sheet having a receiving layer containing a bisphenol-system compound and a porous filler whose oil absorption is 50 ml/100 g or more and transferring the transfer sheet against the thermal head in the range of 1/N of the length of a picture dot or more (N denotes the number of specified repetitive use of the transfer sheet) to not more than the length of the picture dot per one picture dot recording.

8 Claims, No Drawings

HEAT SENSITIVE TRANSFER METHOD

BACKGROUND OF THE INVENTION (a) Field of the Invention

The present invention relates to a heat sensitive transfer method, in particular a heat sensitive transfer method which is capable of obtaining a high density transfer image with microenergy by the use of a transfer sheet having a leuco dye-containing transfer layer and a receiving sheet having a developercontaining receiving layer, and further is capable of obtaining transfer images of uniform image density even when a number of transfer operations are repeated using one and the same transfer sheet.

(b) Description of the Prior Art

As heat sensitive transfer mediums there have been usually known the following ones:

(i) one comprising the combination of a transfer sheet prepared by applying a thermo-sublimating dye on a substrate with a receiving sheet for receiving a thermo-sublimating dye image by virtue of thermal printing from the substrate surface side of said transfer sheet, (ii) the one comprising the combination of a transfer sheet prepared by applying a thermo-fusible substance and a colorant (pigment or dye) on a substrate with a receiving sheet, and the like.

However, the heat sensitive transfer medium referred to in the preceding (i) was defective in that as a heat-subliming dye is used therein, the dye image formed on the receiving sheet is inferior in preservability and therefore there is caused the necessity of overcoating the transfer image.

The heat sensitive transfer referred to in the preceding (ii) was defective in that as the transfer layer is formed by dispersing the pigment or dye in the thermo-fusible substance, when incorporating a large amount of pigment or dye therein for the purpose of obtaining a high density image, its transfer coefficiency is rather deteriorated and consequently it is difficult to obtain a high density image, and further when using a large amount of thermo-fusible substance for the purpose of increasing its heat sensitivity, as a large amount of thermo-fusible substance transfers toward the receiving sheet side, it becomes difficult to strip the transfer sheet and the receiving sheet smoothly and consequently the fine-lined image area becomes blurred, and the like.

In addition, the heat sensitive transfer medium (iii) is known which comprises carrying each of the substances, which thermally react with each other for color-forming, on separate substrates and making these carrying layers face-contact each other to thereby effect thermal printing.

However, this heat sensitive transfer medium (iii) is defective in that as this medium is a reactive type, mere transfer of the transfer layer to the receiving layer at the time of face-contacting can not achieve a sufficient color-forming reaction and consequently a low density image is produced, and that when thermal printing is effected under the heating conditions of high temperature and long time, a higher density image is produced on the receiving sheet but on the other hand an undesirable color-forming reaction is caused (namely, an image is formed) on the transfer sheet.

The inventors of this application have previously proposed various heat sensitive transfer mediums which are capable of improving the above mentioned drawbacks. The heat sensitive transfer mediums of this type can obtain a multiplicity of copies by effecting heat transfer continually in the manner of using one and the same transfer sheet and exchanging the receiving sheets one after another. This heat sensitive transfer can be achieved in the manner of using a heat sensitive type printer equipped with a thermal head and transferring the transfer sheet against this thermal head. In this instance, however, there are caused problems that smudge on the non-image area (scumming) is caused on the copy surface, the obtained image is blurred and the like depending on the kinds of the transfer sheet and the receiving sheet to be used.

SUMMARY OF THE INVENTION

The object of the present invention is to provide a heat sensitive transfer method which can produce an improved quality copy efficiently on effecting heat sensitive transfer by the use of a heat sensitive transfer type printer.

The heat sensitive transfer method according to the present invention comprises using a transfer sheet having a leuco dyecontaining transfer layer and a receiving sheet having a receiving layer containing a bisphenol-system compound represented by the following general formula and a porous filler whose oil absorption is 50 ml/100 g or more:

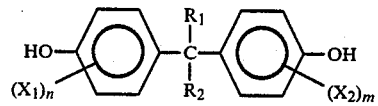

(wherein, $X_1$ and $X_2$ each stands for a lower alkyl group or halogen atom, $R_1$ and $R_2$ each stands for hydrogen or an alkyl group having 1–16 carbon atoms, and n and m each stands for an integer of 0–4), superposing these two sheets so that said transfer layer contacts with said receiving layer, effecting heat transfer while contacting by pressure a thermal head with the transfer sheet, and forming a colored image on the receiving sheet, and is characterized in that said transfer sheet is transferred against the thermal head in the range of 1/N of the length of a picture dot or more (N denotes the number of specified repetitive use of the transfer sheet)to not more than the length of the picture dot per one picture dot recording.

In the above general formula, the lower alkyl groups represented by $X_1$ and $X_2$ include methyl, ethyl, propyl, butyl and the like. The halogen atom includes chlorine, bromine, iodine and fluorine. The alkyl groups having 1–16 carbon atoms represented by $R_1$ and $R_2$ include both chain and branched chain ones.

The method according to the present invention can be practiced by using a heat sensitive transfer type printer. In this instance, this heat sensitive transfer type printer is provided with a thermal head which generates thermal patterns corresponding to recording informations and a feed mechanism which transfers a transfer sheet against this thermal head at a required speed. In other words, according to such a heat sensitive transfer type printer, the transfer sheet is transferred relatively against the thermal head every time when one picture dot is recorded, which can be seen in, for instance, the heat sensitive transfer type typewriter.

Up to now, the transfer sheet has been transferred at a high speed, for instance, in the amount percentage of at least the length of one picture dot per one picture dot recording. Due to this, the obtained transfer images were clear-cut, but the transfer sheet was consumed heavily. Further, this manner was not efficient in that when intending to use a transfer sheet repeatedly a number of times, a long time was taken for winding back said transfer sheet into its original state.

In the case of the present invention, the transfer sheet is transferred against the thermal head at a reduced distance, namely in the range of from 1/N of the length of a picture dot or more (N denotes the number of specified repetitive use of the transfer sheet, for instance N=20) to not more than the length of the picture dot per one picture dot recording, preferably 1/N of the length of the picture dot, whereby consumption of the transfer sheet can be reduced and further the trouble of winding back the transfer sheet can be saved.

The transfer sheet used in the present invention is the one built-up in the manner of forming a transfer layer consisting essentially of a leuco dye and a binder resin on the surface of a substrate such as plastic film, paper or synthetic paper, in particular plastic film. As the leuco dye referred to herein, there may be employed any one which has usually been used in the pressure sensitive paper or heat sensitive paper, for instance those of triphenylmethane system, fluoran system, phenothiozine system. Auramine system and spiropyran system dyes are suitably used. The concrete examples of these leuco dyes are shown hereinafter:

3,3-bis(p-dimethylaminophenyl)-phthalide,
3,3-bis(p-dimethylaminophenyl)-6-dimethylaminophthalide (another name: Crystal Violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2{N-(3'-trifluoromethylphenyl)amino}-6-diethylaminofluoran,
2-{3,6-bis(diethylamino)-9-(o-chloroanilino)xanthyl benzoic acid lactam},
3-diethylamino-6-methyl-7-(m-trichloromehtylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, benzoyl leuco Methylene Blue,
6'-chloro-8'-methoxy-benzoindolino-pyrylospyran,
6'-bromo-3'-methoxy-benzoindolino-pyrylospyran,
3-(2'-hydroxy-4'-diethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'-chloro-5'-methylphenyl)phthalide.

In the present invention, said leuco dye is normally used in the an amount of about 0.3–30 g/m$^2$, preferably about 0.5–20 g/m$^2$, relative to the area of the substrate.

The receiving sheet used in the present invention comprises forming on the substrate, such as paper, synthetic paper, plastic film or the like, a receiving layer containing a bisphenol system compound represented by said general formula and a porous filler, whose oil absorption is 50 ml/100 g or more, as an assistant. The concrete examples of bisphenol compounds represented by said general formula are as enumerated below.

1,1-bis(4'-hydroxyphenyl)methane,
1,1-bis(4'-hydroxyphenyl)ethane,
1,1-bis(4'-hydroxyphenyl)propane,
1,1-bis(4'-hydroxyphenyl)hexane,
1,1-bis(4'-hydroxyphenyl)heptane,
1,1-bis(4'-hydroxyphenyl)-2-propy pentane,
1,1-bis(4'-hydroxyphenyl)-2-ethyl hexane,
2,2-bis(4'-hydroxyphenyl)propane,
2,2-bis(4'-hydroxyphenyl)hexane,
2,2-bis(4'-hydroxyphenyl)heptane,
3,3-bis(4'-hydroxyphenyl)hexane,
1,1-bis(3'-methyl-4'-hydroxyphenyl)ethane,
1,1-bis(3'-methyl-4'-hydroxyphenyl)propane,
1,1-bis(3'-methyl-4'-hydroxyphenyl)butane,
1,1-bis(3'-methyl-4'-hydroxyphenyl)pentane,
1,1-bis(3-methyl-4'-hydroxyphenyl)hexane,
1,1-bis(3'-methyl-4'-hydroxyphenyl)heptane,
2-(3'-methyl-4'-hydroxyphenyl)-2-(4'-hydroxyphenyl)-propane,
1,1-bis(4'-hydroxyphenyl)heptane,
1,1-bis(4'-hydroxyphenyl)-2-propy pentane,
1,1-bis(4'-hydroxyphenyl)-2-ethyl hexane,
2,2-bis(3'-methyl-4'-hydroxyphenyl)pentane,
2,2-bis(5'-methyl-4'-hydroxyphenyl)hexane,
2,2-bis(3'-methyl-4'-hydroxyphenyl)-4-methyl pentane,
1,1-bis(3'-methyl-4'-hydroxyphenyl)-4-methyl butane,
3,3-bis(3'-methyl-4'-hydroxyphenyl)pentane,
3,3-bis(3'-methyl-4'-hydroxyphenyl)hexane,
5,5-bis(3'-methyl-4'-hydroxyphenyl)nonane,
2-(4'-hydroxyphenyl)-2-(3'-chloro-4'-hydroxyphenyl)-propane,
2,2-bis(3'-isopropyl4'-hydroxyphenyl)propane,
2,2-bis(3'-t-butyl-4'-hydroxyphenyl)propane,
2,2-bis(3'-chloro-4'-hydroxyphenyl)propane, 2-(4'-hydroxy-3',5'-dimethylphenyl)-2-(4'-hydroxyphenyl) propane,
bis(3'-methyl-5'-ethyl-4'-hydroxyphenyl)methane, and
1,1-(3'-methyl-5'-butyl-4'-hydroxyphenyl)butane.

The amount of the developer contained in the receiving layer is about 0.2–20 g/m$^2$, preferably about 0.5–10 g/m$^2$.

In the present invention, furthermore, the porous filler applicable to the receiving layer together with said developer includes those whose oil absorption is 50 ml/100 g (based on JIS K 5101 method), preferably 150 ml/100 g or more. When the oil absorption is less than 50 ml/100 g, the object of the present invention can not be achieved. The amount of the porous filler contained in the receiving layer is 0.05–10 wt parts to 1 wt part of the developer, and it is particularly desired from the point of view of obtaining heat sensitivity and uniform transferred image density that the porous filler should be used in the amount of 0.1–3 wt parts. As the concrete examples of the porous filler used in the present invention, there can enumerated, for instance, inorganic and organic fine powders of silica, aluminum silicate, alumina, aluminum hydroxide, magnesium hydroxide, urea-formalin resin, styrene resin and the like.

These fine powders, namely porous fillers, as contained in the receiving layer, desirably should have a particle diameter of 0.01–10 μm, preferably 0.05–5 μm.

In the present invention, furthermore, the receiving layer may contain a thermo-fusible substance having a melting point of 200° C. or less, preferably 150° C. or less, in case of necessity. By keeping such a thermo-fusible substance added in the receiving layer, an image can be obtained with less heating energy.

As the concrete examples of the thermo-fusible substance used in this instance, there can be enumerated the usually known ones, for instance, such as fatty acid amide, aromatic carboxylic acid amide, fatty or aromatic carboxylic acid amides having a cyclohexyl ring, aromatic carboxylic acid alkyl or aryl esters and the like. The amount of the thermo-fusible substance used is 0.1–50 wt parts to 1 wt part of the leuco dye.

When each substrate is provided with a transfer layer and a receiving, layer conventional binders may be used therefor. As such binders, there may be enumerated, for instance, water-soluble, organic solvent-soluble or aqueous emulsion-formable ones such as polyvinyl alcohol, methoxy cellulose, hydroxyethyl cellulose, carboxymethyl cellulose, polyvinyl pyrrolidone, polyacryl amide, polyacrylic acid, starch, gelatin, polystyrene, vinyl chloride-vinyl acetate copolymer, polybutyl methacrylate and the like.

The heat-sensitive transfer medium used in the present invention can be obtained in the manner of dissolving by dispersion the aforesaid components for forming each layer together with the solvent, such as water or the like, by means of a ball mill, a sand mill or the like to thereby prepare a solution for forming each layer and adhering this solution by drying onto each substrate so that the dry adhered amount may be 0.3–30 g/m$^2$.

As described above, the method of the present invention aims at effecting heat sensitive transfer by combining a specific transfer sheet with a specific receiving sheet and transferring the transfer sheet at a fixed speed.

According to the method of the present invention like this, the heat sensitive transfer is carried out effectively, and further a clear-cut high quality image can be obtained on the receiving sheet. That is, in the case of the present invention, the transfer sheet is transferred against the thermal head at the time of recording, and the transfer speed of the transfer sheet is defined within the specific range, whereby the receiving sheet carrying a high quality image can be obtained efficiently by making use of one and the same transfer sheet effectively. Further, the present invention makes it possible to obtain a high density transferred image free from smudge on the non-image area, because the composition of ingredients constructing of the receiving layer of the receiving sheet has been defined in relation to the heat sensitive transfer carried out by transferring the transfer sheet as described above. The method according to the present invention is applicable to the fields of facsimile, typewriter and the like.

EXAMPLE

The "part" and "%" referred to herein are all by weight. First, a transfer sheet and receiving sheets were prepared by the undermentioned prescriptions.

| (1) Preparation of Transfer sheet (A) | |
|---|---|
| Crystal Violet lactone | 10 parts |
| polyvinyl chloride | 1 part |
| methyl ethyl ketone | 89 parts |

A composition consisting of the above components was dispersed for 24 hours by means of a ball mill, and then same was applied on the surface of a 6 μm-thick polyester film by means of a wire bar and dried to thereby prepare a transfer sheet (A) having an adhered amount of about 6 g/m$^2$.

| (2) Preparation of Receiving sheet (B-1) | |
|---|---|
| 1,1-bis(4'-hydroxyphenyl)propane | 30 parts |
| vinyl chloride-vinyl acetate copolymer | 5 parts |
| silica fine powder (oil absorption 200 ml/100 g) | 10 parts |
| methyl cellosolve | 155 parts |

A composition consisting of the above components was dispersed for 24 hours by means of a ball mill, and then same was applied on the surface of a wood free paper (52 g/m$^2$) by means of a wire bar and dried to thereby form a receiving layer having an adhered amount of about 5 g/m$^2$. Thus, a receiving sheet (B-1) was prepared.

(3) Preparation of Receiving sheet (B-2)

A receiving sheet (B-2) was prepared by repeating the exactly the same procedure as employed in the preparation of Receiving sheet (B-1) except that 1,1-bis(4'-hydroxyphenyl)heptane was used as the developer.

| (4) Preparation of Receiving sheet (B-3) | |
|---|---|
| 1,1-bis(4'-hydroxyphenyl)propane | 15 parts |
| 1,1-bis(4'-hydroxyphenyl)heptane | 15 parts |
| aqueous emulsion of vinyl chloride-vinyl acetate copolymer | 5 parts |
| silica fine powder (oil absorption 200 ml/100 g) | 10 parts |
| water | 155 parts |

A composition consisting of the above components was dispersed for 24 hours by means of a ball mill, and then same was applied on the surface of a wood free paper (52 g/m$^2$) by means of a wire bar and dried to thereby form a receiving layer having an adhered amount of about 5 g/m$^2$.

Thus, a receiving sheet (B-3) was prepared.

(5) Preparation of Receiving sheet (C-1)

A comparative receiving sheet (C-1) was prepared by repeating exactly the same procedure as employed in the preparation of Receiving sheet (B-3) except that p-hydroxy benzoic acid butylester (15 parts) was used in place of 1,1-bis(4'-hydroxyphenyl) propane (15 parts).

Next, heat sensitive transfer tests were carried out by using the thus obtained transfer sheet and receiving sheets. In this instance, a heat sensitive transfer printer equipped with a thermal head for use in typewriter was employed as a heat sensitive transfer apparatus. This apparatus is the one which includes a transfer sheet (transfer ribbon) feed mechanism for transferring the transfer sheet and can control the transfer speed of the transfer sheet against the thermal head.

In the above heat sensitive transfer tests, the number N of specified repetitive use of the transfer sheet was set to be 10 times and the relative transfer speed of the transfer sheet to the thermal head was regulated so as to be in the range of 1/10 of the length of the picture dot.

The heating energy exerted on the thermal head was regulated to be 1 mJ.

The quality of the thus obtained developed color images on the receiving sheet was evaluated in relation to the receiving sheet respectively. The obtained results are shown in Table 1.

The image density was measured by means of Macbeth RD-514.

TABLE 1

| Experiment No. | Transfer sheet | Receiving sheet | Image density | Image definition | Smudge on non-image area |
|---|---|---|---|---|---|
| 1 | A | B-1 | 1.23 | good | none |
| 2 | A | B-2 | 1.20 | good | none |
| 3 | A | B-3 | 1.05 | good | none |
| 4(*) | A | C-1 | 1.32 | bad | observed |

(*)Comparative example

We claim:

1. In a heat sensitive transfer method in which (1) a transfer sheet having a transfer layer containing a leuco dye, and (2) a receiving sheet having a receiving layer containing (a) a bisphenol compound having the formula

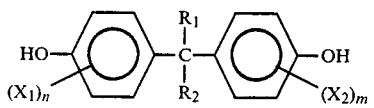

wherein $X_1$ and $X_2$ are lower alkyl or halogen, $R_1$ and $R_2$ are hydrogen or alkyl having from 1 to 16 carbon atoms, and n and m are integers of from 0 to 4, and (b) a porous filler having an oil absorption of 50 ml/100 or more, are superposed so that said transfer layer contacts said receiving layer, and a thermal head is repetitively pressed against said transfer sheet and, during each pressing, said thermal head selectively heats said transfer sheet in a dot image pattern to thermally transfer said leucodye to said receiving layer to produce a visible dot image pattern on said receiving sheet and wherein said thermal head and said receiving sheet are shifted with respect to each other between successive repetitions of the pressing and thermal transfer step so a multiplicity of dot images providing visible information is recorded on said receiving sheet, and the same transfer sheet is used to record visible information on a plurality of receiving sheets, the improvement which comprises: between successive pressings of said thermal head against the same area of said transfer sheet, said transfer sheet is shifted laterally with respect to said thermal head a distance in the range of from L/N to L, wherein L is the length of one of said dots and N is the number of times the same transfer sheet is used to record visible information on receiving sheets.

2. A method according to claim 1 wherein the transfer layer contains said leuco dye in an amount in an amount in the range of 0.3–30 g/m$^2$.

3. A method according to claim 1 wherein the receiving layer contains said bisphenol compound in an amount in the range of 0.2–20 g/m$^2$.

4. A method according to claim 1 wherein the receiving sheet contains the porous filler in an amount in the range of 0.05–10 wt parts per 1 wt part of said bisphenol compound.

5. A method according to claim 1 wherein the porous filler is silica, aluminum silicate, alumina, aluminum hydroxide, magnesium hydroxide, urea-formalin resin or styrene resin.

6. A method according to claim 1 wherein the receiving layer is added with a thermo-fusible substance having a melting point of 200° C. or less.

7. A method according to claim 6 wherein the amount of the thermo-fusible substance is 0.1–50 wt parts per 1 wt part of the leuco dye.

8. In a heat sensitive transfer method, comprising the steps of: (A) superposing (1) a transfer sheet having a transfer layer containing a leuco dye, and (2) a receiving sheet having a receiving layer containing (a) a bisphenol compound having the formula

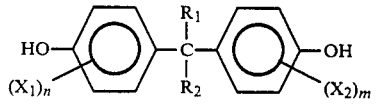

wherein $X_1$ and $X_2$ are lower alkyl or halogen, $R_1$ and $R_2$ are hydrogen or alkyl having from 1 to 16 carbon atoms, and n and m are integers of from 0 to 4, and (b) a porous filler having an oil absorption of 50 ml/100 or more, so that said transfer layer contacts said receiving layer; (B) pressing a thermal head against said transfer sheet and selectively heating said transfer sheet in a dot image pattern to thermally transfer said leuco dye to said receiving layer to produce a visible dot image pattern on said receiving sheet; then shifting said transfer sheet laterally with respect to said thermal head a distance in the range of from L/N to L, wherein L is the length of one of said dots and N is the number of times the same transfer sheet is used to record visible information on different receiving sheets; and then repeating step (B), whereby said thermal head does not heat said transfer sheet in exactly the same areas.

* * * * *